US007308997B2

(12) United States Patent
Neumann et al.

(10) Patent No.: US 7,308,997 B2
(45) Date of Patent: Dec. 18, 2007

(54) COMBUSTION-OPERATED SETTING TOOL

(75) Inventors: Jens Neumann, Shanghai (CN); Norbert Heeb, Buchs (CH); Tilo Dittrich, Gams (CH); Thomas Sperrfechter, Gruesch (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/404,935

(22) Filed: Apr. 14, 2006

(65) Prior Publication Data

US 2007/0000458 A1 Jan. 4, 2007

(30) Foreign Application Priority Data

Apr. 12, 2005 (DE) ..... 10 2005 000 032

(51) Int. Cl.
*B25C 1/14* (2006.01)
*F02B 71/00* (2006.01)

(52) U.S. Cl. ..... 227/10; 227/9; 123/46 SC; 123/46 H; 123/46 R; 123/23; 123/24 R

(58) Field of Classification Search ..... 123/46 SC, 123/46 H, 46 R, 23, 24 R, 24 A; 227/130, 227/10, 29; 173/209
See application file for complete search history.

(56) References Cited

U.S. PATENT DOCUMENTS 4,773,581 A * 9/1988 Ohtsu et al. ..... 227/10
6,321,968 B1 * 11/2001 Remerowski ..... 227/10
6,755,335 B2 * 6/2004 Fielitz ..... 227/10

FOREIGN PATENT DOCUMENTS

DE 199 62 584 C1 * 6/2001
DE 199 62 697 C1 * 6/2001

* cited by examiner

*Primary Examiner*—Stephen K. Cronin
*Assistant Examiner*—Ka Chun Leung
(74) *Attorney, Agent, or Firm*—Abelman, Frayne & Schwab

(57) ABSTRACT

A combustion-operated setting tool for driving fastening elements in a constructional component includes a device (30) for adjusting setting energy applied to a setting piston (15) axially displaceable in a guide space (4) of a piston guide (13). The adjusting device (30) has a separation member (31) adjustably arranged between the receptacle (18) and the guide space (14) of the piston guide (13) and dividing the combustion chamber (20) in a first sub-chamber (21) arranged between the receptacle (18) and the separation member (31) and a second sub-chamber (22) arranged between the separation member (31) and the guide space (14) of the piston guide (13), the separation member (31) having a plurality of through-openings (34, 35) for controlling flow of the combustion gases into the guide space (14) of the piston guide (13), with an active opening cross-section of at least a portion of the through-openings (34, 35) changing dependent on an adjustable position of the separation member (31).

9 Claims, 6 Drawing Sheets

COMBUSTION-OPERATED SETTING TOOL

BACKGROUND OF THE INVENTION

1. Field of the Invention

The present invention relates to a combustion-operating setting tool for driving fastening elements in a constructional component and including a piston guide, a setting piston displaceably arranged in the guide space of the piston guide, a combustion chamber adjoining the piston guide, a receptacle for receiving a propellant charge and adjoining the combustion chamber at an end of the combustion chamber remote from the piston guide, a separation member adjustably arranged between the receptacle and the guide space of the piston guide and dividing the combustion chamber in a first sub-chamber arranged between the receptacle and the separation member and a second sub-chamber arranged between the separation member and the guide space of the piston guide with the separation member having a plurality of through-openings for communicating flow of the combustion gases into the guide space of the piston guide and having an active opening cross-section, and a device for adjusting the setting energy by controlling the combustion gases applied to the setting piston.

2. Description of the Prior Art

Setting tools of the type described above are driven with solid fuels in a powder or pellet form, with the setting piston being driven by combustion gases generated as a result of fuel combustion. With the setting piston, fastening elements can be driven in a constructional component.

German Publication DE 199 83 546 A1 discloses a hand-held, powder charge-operated setting tool in which a setting piston is displaceable in a guide space of a piston guide. At one end of the piston guide, which is formed as a guide cylinder, there is provided a receptacle for receiving a propellant charge and which is adjoined, in the direction of the setting piston, by a combustion chamber. The combustion chamber is divided by a separation member, which is formed as a plate with a plurality of openings. The separation member is fixedly secured in the inner space of the guide cylinder. The setting tool also includes a device for changing the driving force. The changing device adjusts the volume of a portion of the combustion chamber that is adjacent to the setting piston. To this end, the changing or adjusting device has a power adjusting arm arranged on the setting piston and which is engaged by adjusting means in form of a screw. With the adjusting arm, the upper end position of the setting piston and, thus, the volume of the second sub-chamber above the setting piston can be adjusted. According to another embodiment, sidewise of the second sub-chamber, there is provided an additional chamber that is connected with the combustion chamber by an adjustable valve. The volume of the additional chamber is adjusted with a displaceable plate that forms a wall of the additional chamber.

The drawback of the adjusting device consists in that a number of additional measures need be taken which require an additional constructional space and noticeably increase the production costs.

Accordingly, an object of the present invention is a setting tool of the type described above in which the drawbacks of the known setting tool are eliminated and a simple setting energy regulation is achieved.

SUMMARY OF THE INVENTION

This and other objects of the present invention, which will become apparent hereinafter, are achieved by providing a setting tool in which the guide, dividing the combustion chamber in a first sub-chamber arranged between the receptacle and the separation member and a second sub-chamber arranged between the separation member and the guide space of the piston guide, with the separation member having a plurality of through-openings for controlling flow of the combustion gases into the guide space of the piston guide, with the through-openings having an active opening cross-section, and with an active opening cross-section of at least a portion of the through-openings changing dependent on an adjustable position of the separation member.

Due to the fact that at least a portion of the through-openings is closed partially or completely dependent on the position of the separation member, their active opening cross-section, which limits the flow of the combustion gases through the through-openings, can be reduced or even closed completely. With such a separation member, the energy, which is produced by the propellant charge and is applied to the setting piston, can be easily controlled by changing the active opening cross-section, substantially without using means that would require additional constructional space. Further, the used means is cost-effective, as only a very small adaptation any few additional parts are needed.

It is advantageous, when the piston guide is provided with channels, and at least a portion of the through-openings of the separation member can be displaced relative to the channels of the piston guide. Thereby, the control and, if needed, splitting of the combustion gases can be easily achieved. The channels can be formed as release channels or as channels extending in a direction of the guide space.

The separation member can be easily adjusted when it is supported for a pivotal movement parallel to the longitudinal axis of the piston guide. To this end, the separation member is provided with a circular disc-shaped base body easily adjustable by rotation. The separation member can be connected with an adjusting member with which a position of the separation member can be adjusted.

Advantageously, the plurality of through-openings of the separation member includes first through-openings extending through the separation member parallel to an axis of the piston guide for conducting the combustion gases from the first sub-chamber into the second sub-chamber. Thereby, the path of the combustion gases is not obstructed even when a portion of the combustion gases is released in the environment through corresponding further through-openings and, if needed, channels.

It is advantageous when there is provided a counter-member arranged in the piston guide in an abutting relationship with the separation member and having a plurality of channels. With the counter-member, in a simple way, the through-openings of the separation member can be partially or completely closed, with a possible reduction of the active opening cross-section to zero, dependent on the adjustable position of the separation member. Advantageously, the plurality of channels of the counter-member includes first channels extending parallel to a longitudinal axis of the piston guide through the counter-member for conducting the combustion gases form the first sub-chamber to the second sub-chamber. The first channels of the counter-member can partially or completely overlap the first through-openings of the separation member, dependent on the position of the separation member, whereby the active opening cross-section of the first through-openings of the separation member can be controlled.

It is further advantageous when the plurality of channels of the counter-member includes second channels that open at their ends remote from the separation member into release channels formed in the piston guide and can be brought into an overlapping relationship with some of the plurality of the through-openings of the separation member for releasing into environment at least a portion of the combustion gases from the first sub-chamber.

This prevents, in particular, over-high pressure in the first sub-chamber of the combustion chamber when the first through-openings of the separation member are partially closed, and their active opening cross-section is reduced. A maximal setting energy from the propellant charge can be obtained when the first through-openings of the separation member, which lead to the guide space, are completely open, and no combustion gases are released in the environment. The setting energy, however, is reduced when the combustion gases are released in the environment and/or the active opening cross-section that leads to the guide space, is reduced.

It is further advantageous when, in the absence of the counter-member, the separation member has a cylindrical section that extends coaxially with a longitudinal axis of the piston guide and has two through-openings formed in its cylindrical wall and radial outer ends of which can be brought in an overlapping relationship with release channels formed in the piston guide for releasing into environment at least a portion of the combustion gases from the second sub-chamber. The reduction of the setting energy is effected only by releasing the combustion gases in the environment. Thus, the maximal setting energy of the propellant charge can be obtained when no combustion gases are released in the environment. The setting energy, however, is reduced when the combustion gases are released in the environment.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
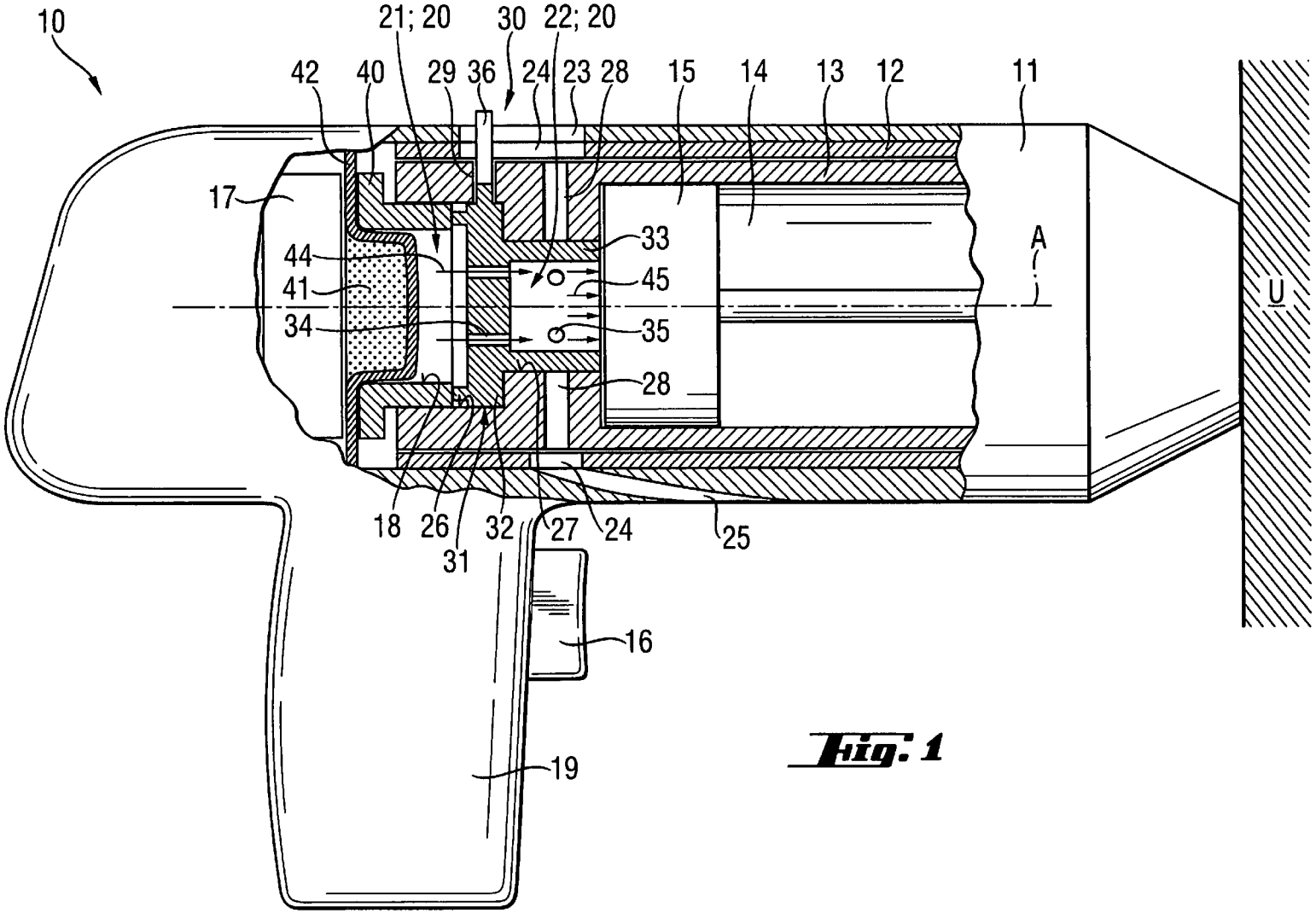
FIG. 1 a cross-sectional view of a first embodiment of a setting tool according to the present invention in a condition, in which the tool is pressed against a constructional component, and with first energy adjustment.
Figure 2:
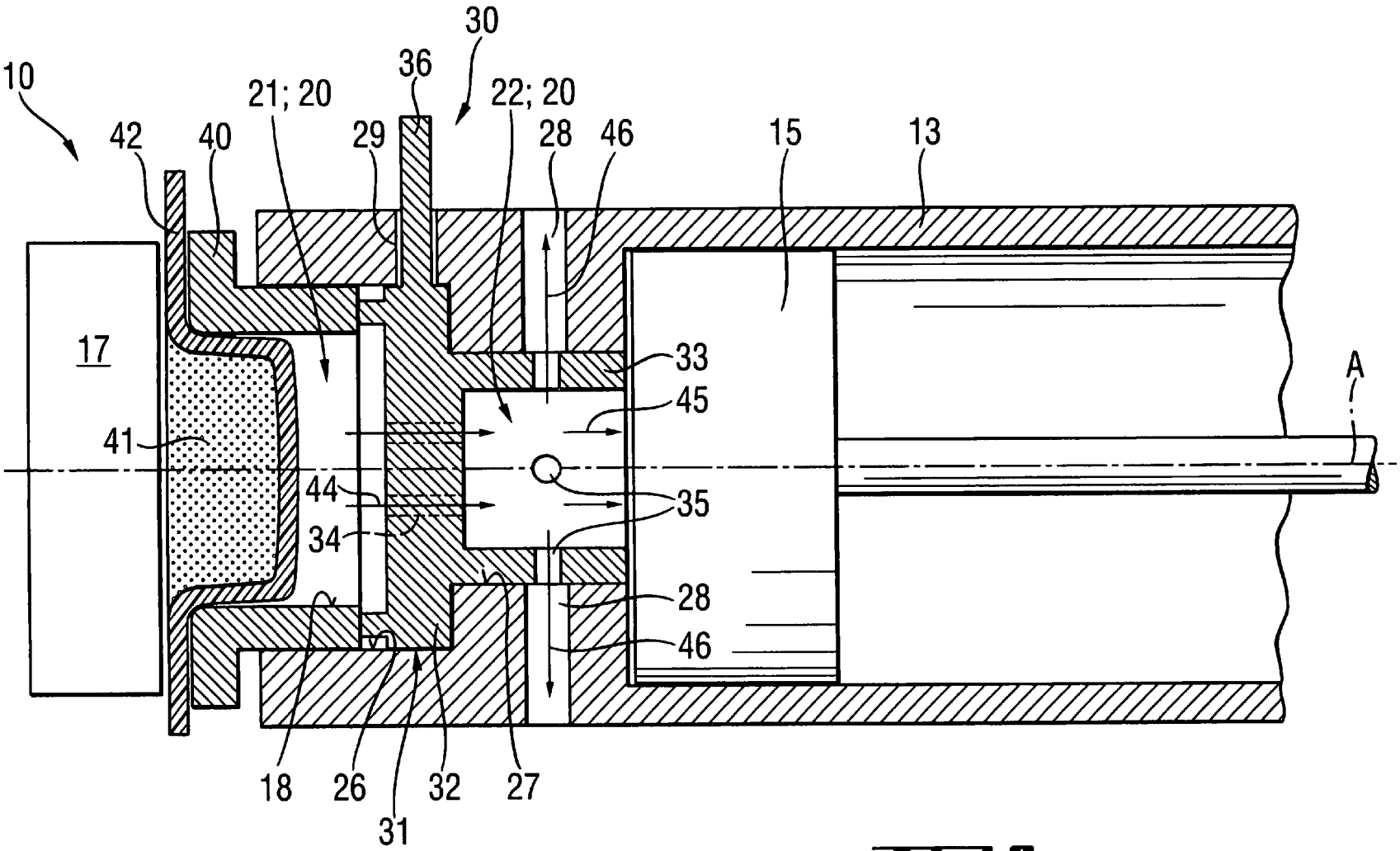
FIG. 2 a partial cross-sectional view of the setting tool shown in FIG. 1 at an increased, in comparison with FIG. 1, scale, with a second energy adjustment.

A combustion-operated setting tool 10 according to the present invention, which is shown in FIGS. 1-2, has a housing 11, a one- or multi-part sleeve-shaped member 12 located in the housing 11, and a piston guide 13 displaceably arranged in the sleeve-shaped member 12. A setting piston 15 is arranged in the guide space 14 of the piston guide 13 for an axial displacement therein. The piston 14 is driven by a propellant charge 41 such as, e.g., a blister cartridge received in a receptacle 18, e.g., a cartridge socket. The propellant charge 41 can be arranged, together with further propellant charges on a magazine strip. The receptacle 18 is formed in an annular support part 40 received in a first receiving chamber 26 provided at the end of the piston guide 13. In a press-on position of the setting tool 10 against a constructional component, which is shown in FIGS. 1-2, the receptacle 18 is closed with a bottom 17, and the propellant charge 41 becomes closed in a chamber of the receptacle 18. Preferably, the support part 40 is formed as a sealing bush. The propellant charge 41 is ignited with an ignition unit, not shown. The ignition unit can be activated electronically or mechanically, e.g., with an elastically operating spark plug. Actuation of the ignition unit is effected with an actuation switch 16 provided on the handle 19 of the setting tool 10. A combustion chamber 20 is provided between the bottom 17 and the guide space 14. The combustion of the propellant charge 41 after its ignition takes place in the combustion chamber 20.

The setting tool 10 further includes a device for adjusting the setting energy generally designated with a reference numeral 30. The energy-adjusting device 30 has a separation member 31 that divides the combustion chamber 20 in a first sub-chamber 21 adjacent to the bottom 11, and a second sub-chamber 22 adjacent to the guide space 14. The separation member 31 pivots about a pivot axis extending parallel to a longitudinal axis A defined by the combustion space 14. The separation member 31 has a base body 32 in form of an annular plate or a circular disc. The circular disc-shaped base body 32, which is arranged in the first receiving chamber 26 of the piston guide 13 and directly adjoins the support part 17, has first through-opening 34 which extend parallel to the longitudinal axis A and connect the first sub-chamber 21 of the combustion chamber 20 with a second sub-chamber 22. The separation member 31 further has a cylindrical section 33 extending in a second receiving chamber 27 of the piston guide 13. The cylindrical section 33 is coaxial with the circular disc-shaped base body 32. In the cylindrical wall of the cylindrical section 33, there are provided second through-openings 35 which can be brought in an overlapping relationship with channels 28 in the piston guide 13 which are formed as release channels. The channels 28 are connected with the environment over sleeve openings 24 and housing openings 23 and further over release housing openings 25.

The separation member 31 can be manually pivoted with an adjusting member 36 that branches out of the circular disc-shaped base body 32 and extends through a slot 29 in the piston guide 13. The pivotal movement of the separation member 31 changes the position of the second through-openings 35 relative to the channels 28 and, thereby, an active opening cross-section of the through-openings 35 through which the combustion gases flow.

In FIG. 1, the separation member 31 is shown in a first position in which the second through-openings 35 do not open into the channels 28, and the active opening cross-section of the second through-openings 35 is zero. Upon ignition of the propellant charge 41, the expanding combustion gases flow in the direction of arrows 44, 45, completely acting on the setting piston 15. In this position, the maximal combustion energy is imparted to the setting piston 15.

FIG. 2 shows a second position of the separation member 31 in which the second through-openings 35 completely overlap the channels 28, completely opening thereinto. Therefore, the active opening cross-section of the through-openings 35 is at its maximum. Upon ignition of the propellant charge 41, the expandable gases firstly, flow in the direction of arrow 44 and then in the direction of arrows 45, 46, dividing the gas stream. Thereby, the action of combustion gases on the setting piston 15 is reduced. In this position of the separation member 31, a minimal combustion energy is imparted to the setting piston 15 because a portion of the combustion gases flows from the second sub-chamber 22 of the combustion chamber 20 in the environment in the direction of arrow 46.

By positioning the separation member 31 in intermediate positions with greater or smaller overlapping of the second through-openings 35 with the channels 28, the setting energy can be adjusted between minimal and maximal setting energies. The first and second positions of the adjusting member 36 can be defined with appropriate stops. These stops are formed in the same way as stops 43 and 47 of another embodiment which is shown in FIGS. 5-6.

The manually operated adjusting member can be replaced with an automatic adjusting member that can be controlled with appropriate control means. In this case, an optimal energy adjustment is effected based on different setting parameters such as, e.g., type of the constructional component, the required setting depth, type of to-be-set fastening elements, etc. The adjusting member can also be provided on the support part and the pivotal movement can be transmitted from the support part to the separation member by an appropriate gear arrangement. Further, the support part and the separation member can be formed integrally with each other as a one-piece part.

A setting tool 10, which is shown in FIGS. 3-6, differs from the previously discussed setting tool in that the energy-adjusting device 30 has a separation member 31 with a base body 32 that is formed with both first and second openings 34, 35 extending parallel to the longitudinal axis A and with the branched-out adjusting member 36. In the second receiving chamber 27 of the setting piston guide 13, the separation member 31 is arranged directly against a counter-member 37 which is formed as a perforated plate. In the plate 37, there are formed first channels 28 extending parallel to the longitudinal axis A and second channels 39 which bend from axial direction in a radial direction.

Figure 3:
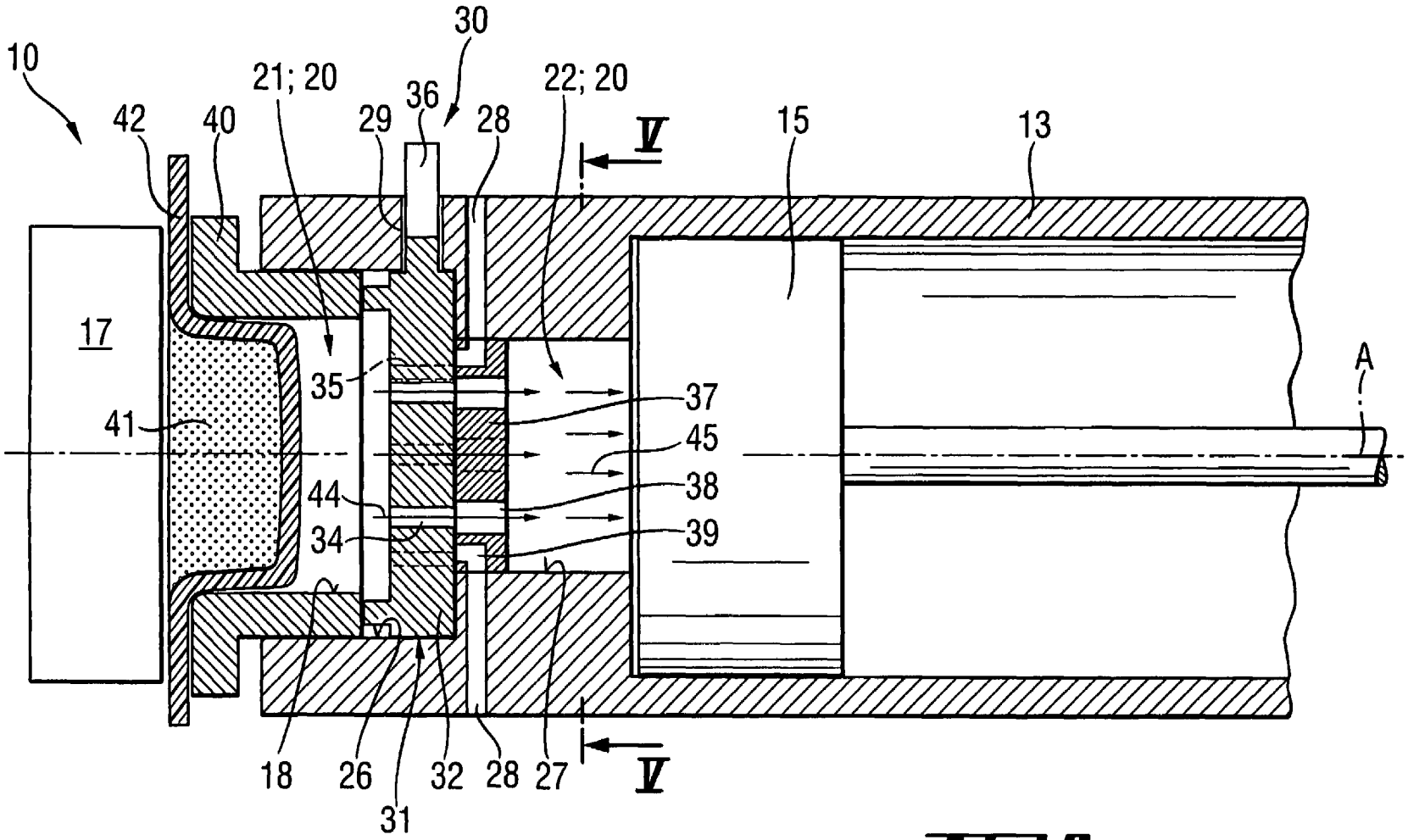
FIG. 3 a partial cross-sectional view of a second embodiment of a setting tool according to the present invention in a condition, in which the tool is pressed against a constructional component, and with first energy adjustment.
Figure 4:
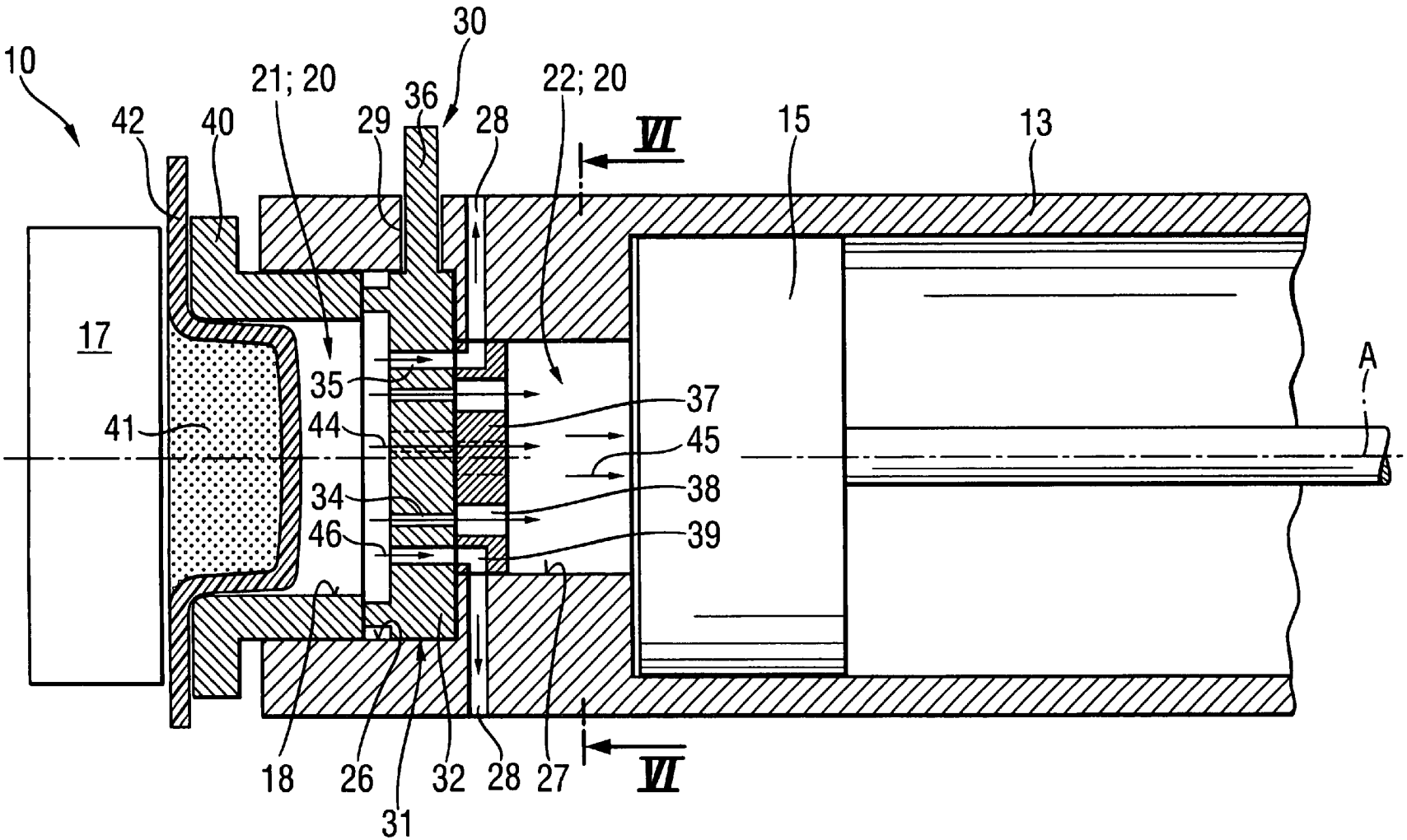
FIG. 4 a partial cross-sectional view of the setting tool shown in FIG. 3 with a second energy adjustment.
Figure 5:
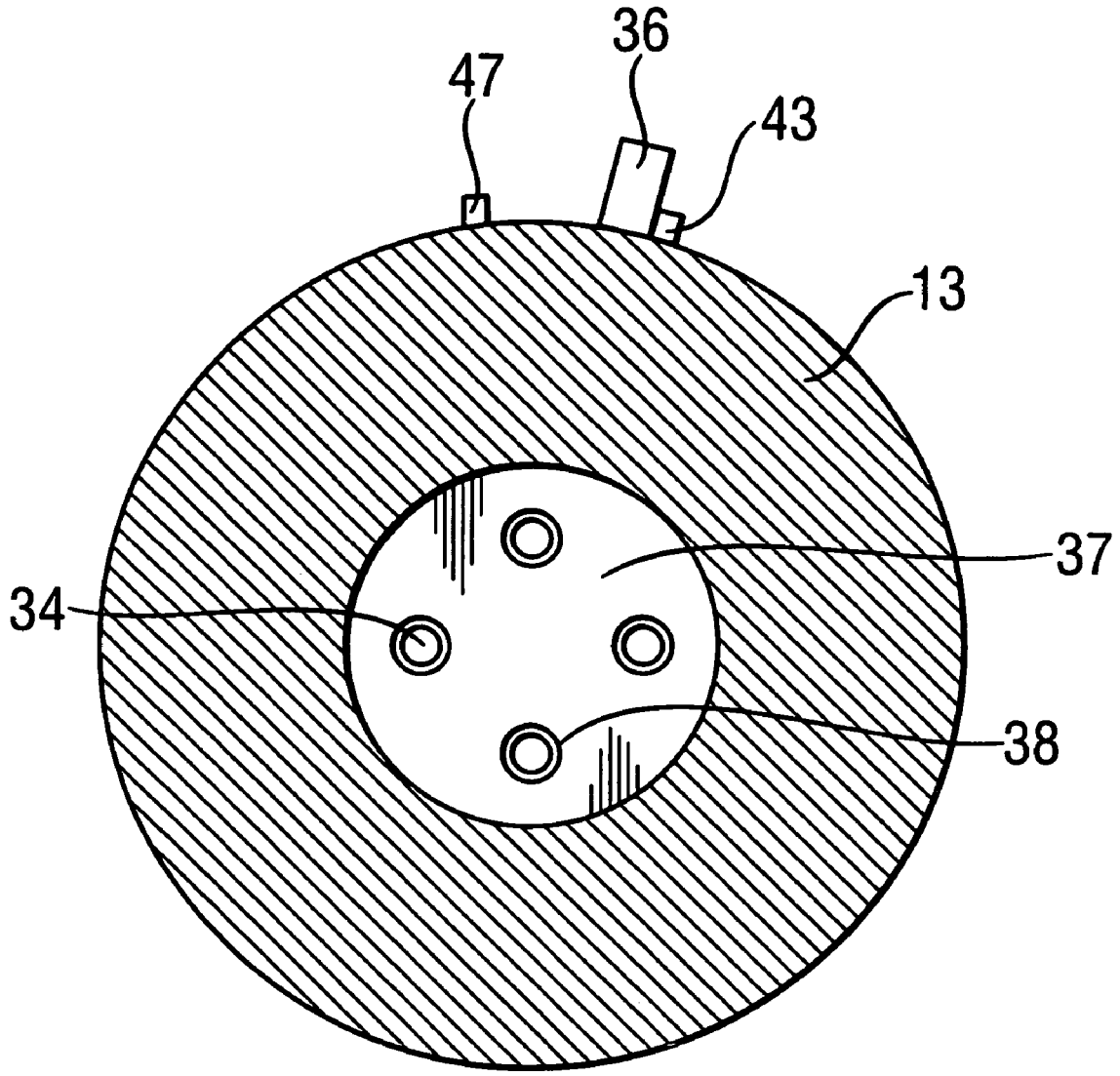
FIG. 5 a cross-sectional view along line V-V in FIG. 3.
Figure 6:
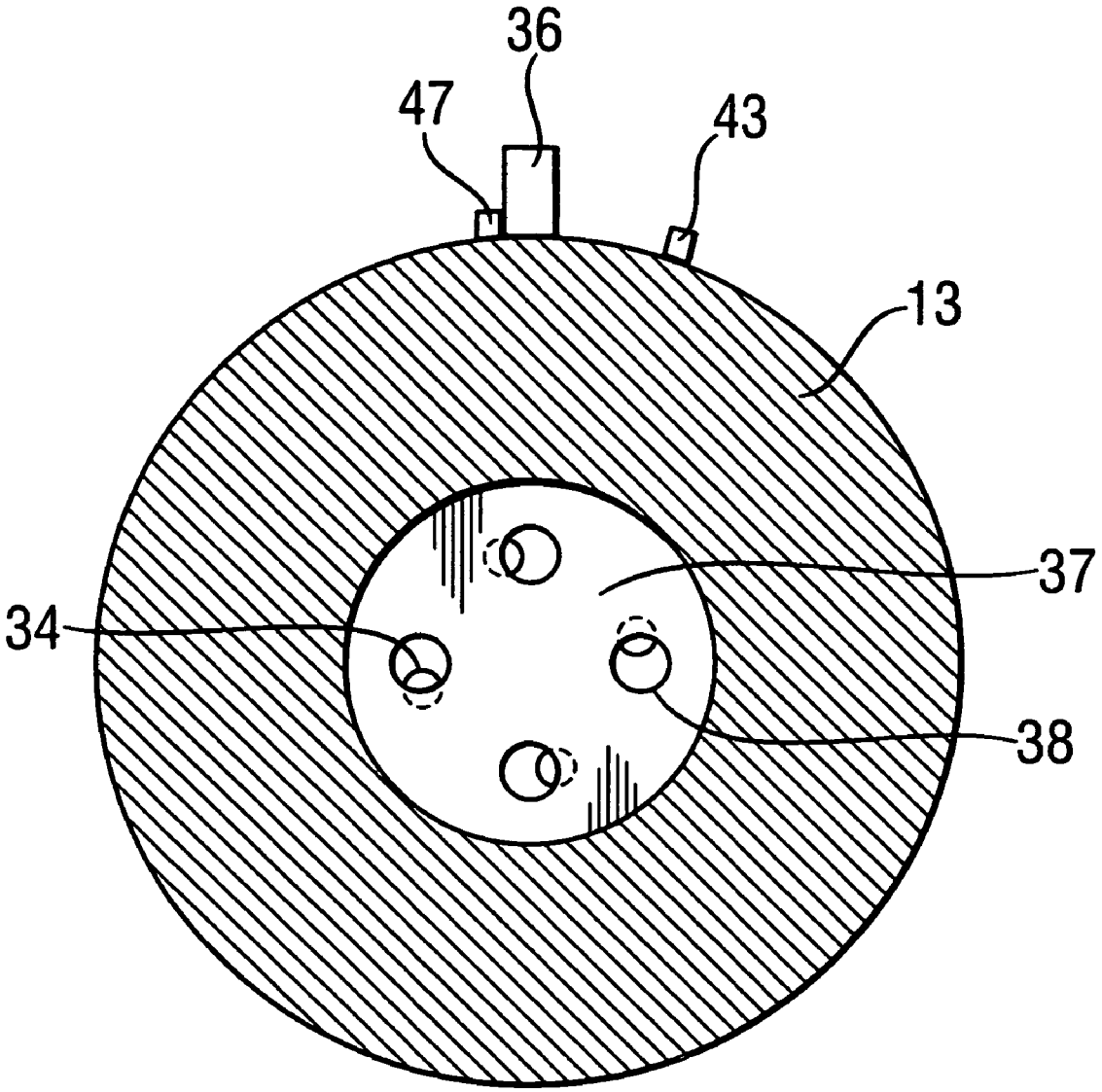
FIG. 6 a cross-sectional view along line VI-VI in FIG. 4.

FIGS. 3-5 show a position of the separation member 31 in which the setting tool 10 operates with the maximal setting energy. The adjusting member 36 of the separation member 31 abuts the stop 43, whereby the first through-openings 34 of the separation member 31 are completely overlapped by the first channels 38 of the counter-member 37, so that the active opening cross-section of the first through-openings 34 is maximal. The second through-openings 35 are not open in the second channels 39, they are not overlapped by them. Their active cross-section is, therefore, zero. During a combustion process of a propellant charge 41 in the combustion chamber, the expanding combustion gases would flow only through the first through-openings 34 and the first channels 38 in the direction of arrows 44 and 45 completely in the direction toward the setting piston 15 which is, thus, driven with a maximal combustion energy.

FIGS. 4 and 6 show a position of the separation member 31 in which the setting tool 10 operates with a minimal energy. The adjusting member 36 of the separation member 31 abuts the stop 47, and the first through-openings 34 of the separation member 31 are overlapped by the first channel 38 of the counter-member 37 by about 50%. The active opening cross-section of the first through-openings 34 is, thus, also amounts to about 50%. The second through-openings 35 open completely in the second channels 39 or are completely overlapped by them, and their active opening cross-section is maximal. Upon combustion of the propellant charge 41 in the combustion chamber, the expanding combustion gases flow through the first through-openings 34 and the first channels 38 of the counter-member 37 in the direction of arrows 44, 45 in the direction toward the setting piston 15, on one hand and, on the other hand, flow through the second through-openings 35 and the second channels 39 as well as the first channels 38 into environment. Thus, the setting piston 15 is driven with a minimal energy.

Here, likewise, the separation member 31 can be positioned in intermediate positions, with the first through-openings 34 being overlapped with the first channels 38 of the counter-member 37 to a greater or lesser extent and the second through-openings 35 being overlapped with the second channels 39, so that the setting energy can be stepwise adjusted between minimal and maximal possible energy.

The counter-member 37 can be formed integrally with the piston guide 13 as a one-piece part. With respect to other details of the embodiment shown FIGS. 3-6, not explicitly shown with reference numerals, reference should be made to the description of the embodiment shown in FIGS. 1 and 2.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A solid propellant-driven setting tool for driving fastening elements in a constructional component, comprising a piston guide (13) having a guide space (14);

a setting piston (15) displaceably arranged in the guide space (14) of the piston guide (13);

a combustion chamber (20) adjoining the piston guide (13);

a receptacle (18) for receiving a solid propellant charge (41) and adjoining the combustion chamber (20) at the end of the combustion chamber (20) remote from the piston guide (13); and a means (30) for adjusting the setting energy by controlling an amount of combustion gases applied to the setting piston (15), the setting energy adjusting means (30) having a separation member (31) adjustably arranged between the solid propellant charge receptacle (18) and the guide space (14) of the piston guide (13) and dividing the combustion chamber (20) in a first sub-chamber (21) arranged between the receptacle (18) and the separation member (31) and a second sub-chamber (22) arranged between the separation member (31) and the guide space (14) of the piston guide (13), the separation member (31) having a plurality of through-openings (34, 35) for controlling flow of the combustion gases into the guide space (14) of the piston guide (13), the through-openings (34,35) having an active opening cross-section, with an active opening cross-section of at least a portion of the through-openings (34, 35) changing dependent on an adjustable position of the separation member (31).

2. A setting tool according to claim 1, further comprising a counter-member (37) arranged in the piston guide (13) in an abutting relationship with the separation member (31) and having a plurality of channels (38, 39).

3. A setting tool according to claim 2, wherein the plurality of channels (38, 39) of the counter-member (37) comprises first channels (38) extending parallel to a longitudinal axis of the piston guide (13) through the counter-member (37) for conducting the combustion gases from the first sub-chamber (21) to the second sub-chamber (22).

4. A setting tool according to claim 3, wherein the plurality of channels (38, 39) of the counter-member (37) comprises second channels (39) opening, at ends thereof remote from the separation member (31), into release channels (28) formed in the piston guide (13) and which can be brought in an overlapping relationship with some of the plurality of the through openings (35) of the separation member (31) for releasing into environment at least a portion of the combustion gases from the first sub-chamber (21).

5. A setting tool according to claim 1, wherein the piston guide (13) has channel means (28, 38, 39), and wherein at least a portion of the through-openings (34, 35) of the separation member (31) can be displaced relative to the release channels (28) of the piston guide (13).

6. A setting tool according to claim 1, wherein the separation member (31) is supported for pivotal movement about a longitudinal axis (A) of the piston guide (13).

7. A setting tool according to claim 1, wherein the separation member (31) comprises a circular disc-shaped base body (32).

8. A setting tool according to claim 1, wherein the plurality of through-openings (34, 35) of the separation member (31) comprises first through-openings (34) extending through the separation member (31) paralled to an axis (A) of the piston guide (13) for conducting the combustion gases form the first sub-chamber (21) into the second sub-chamber (22).

9. A setting tool according to claim 1, wherein the separation member (31) has a cylindrical section (33) that extends coaxially with a longitudinal axis of the piston guide (13) and has two through-openings (35) formed in a cylindrical wall thereof and radial outer ends of which are brought in an overlapping relationship with release channels (28) formed in the piston guide (13) for releasing into environment at least a portion of the combustion gases from the second sub- chamber (22).

* * * * *